United States Patent [19]

Cowdroy

[11] 4,138,176

[45] Feb. 6, 1979

[54] DRAWER MOUNTING ARRANGEMENT

[75] Inventor: Thorp C. Cowdroy, Balgowlah, Sydney, Australia

[73] Assignee: Clive Investments Pty Limited, Balgowlah, Australia

[21] Appl. No.: 792,534

[22] Filed: May 2, 1977

[30] Foreign Application Priority Data

May 7, 1976 [AU] Australia ..... 5852/76

[51] Int. Cl.[2] ..... A47B 88/04; A47B 88/12

[52] U.S. Cl. ..... 312/341 NR; 308/3.6; 312/350

[58] Field of Search ..... 312/337, 352, 330, 341, 312/345, 350; 308/3.6, 3.8

[56] References Cited

U.S. PATENT DOCUMENTS

| | | | |
|---|---|---|---|
| 917,429 | 9/1909 | Green et al. | 312/345 |
| 1,130,167 | 2/1915 | Ingells | 308/3.6 |
| 2,601,494 | 8/1971 | De Boer | 312/341 R |
| 2,944,865 | 7/1960 | Hammesfahr | 312/341 R |
| 2,961,284 | 11/1960 | Sturm | 312/350 |
| 3,160,448 | 12/1964 | Abernathy et al. | 308/3.6 |
| 3,222,117 | 12/1965 | Schwartz | 312/350 R |
| 3,321,253 | 5/1967 | Everburg | 312/341 N |
| 3,456,996 | 7/1969 | Heiniger-Schar | 312/330 |
| 3,653,735 | 4/1972 | Duepree | 312/330 |
| 3,813,132 | 5/1974 | Sahm | 312/341 N |
| 3,834,783 | 9/1974 | Jenkins | 312/350 R |
| 3,927,918 | 12/1975 | Dobbratz | 312/341 N |

FOREIGN PATENT DOCUMENTS

| | | | |
|---|---|---|---|
| 2026209 | 5/1970 | Fed. Rep. of Germany | 312/350 R |
| 2353372 | 5/1974 | Fed. Rep. of Germany | 312/350 R |
| 1282698 | 4/1902 | France | 312/341 R |
| 51788 | 0000 | Switzerland | 312/330 |
| 576244 | 2/1973 | Switzerland | 312/350 R |
| 943077 | 11/1963 | United Kingdom | 312/350 |

*Primary Examiner*—Mervin Stein
*Assistant Examiner*—Alex Grosz
*Attorney, Agent, or Firm*—Lindenberg, Freilich, Hornbaker, Wasserman, Rosen & Fernandez

[57] ABSTRACT

A drawer mounting arrangement of the type which includes a pair of slider elements mounted on the drawer and a pair of rail elements mounted on the drawer frame for slidably supporting the slider elements. A first of the elements has a pair of longitudinally-extending first flanges, while a second of the elements has a second flange that extends between the first flanges and that has an enlarged rounded distal end. The first flanges can be formed with ridges to provide a narrow contact area with the enlarged rounded end of the first flange. A pair of low friction plastic spacer elements lie at either side of the wooden drawer to keep it spaced from the sides of the frame and provide low friction guiding of the drawer.

2 Claims, 11 Drawing Figures

DRAWER MOUNTING ARRANGEMENT

The present invention relates to drawer mounting arrangements of the type in which a first element affixed to the drawer makes sliding contact with a second element affixed to the surrounding frame. The first element is usually a relatively short runner with the second element embodied as an elongate rail or runway. These elements may, however, be of approximately equal length or again, the first element may be substantially longer than the second.

In a known type of drawer mounting, two sliders are mounted each upon an opposite longitudinal side of the drawer and adjacent the rear so as to engage with a corresponding pair of rails spaced from the sides of the drawer and affixed to the frame. The sliders are each in the form of a horizontally extending bar which moves between an upper and lower flange on the support rail.

A significant disadvantage associated with a drawer mounting arrangement of this type is its limited load carrying capacity. If excessive load is applied to the drawer, its forward end sags while each runner twists and tends to jam in its rail with the forward portion of each runner deflecting upwardly as the rearward portion deflects in a downward sense. Even if the mounting arrangement is not damaged, there is a substantial increase in the frictional force required to operate the drawer.

A further disadvantage of the above type of drawer mounting is the necessary reduction in the maximum avaliable drawer width for any given cavity space in the frame.

It is an object of the present invention to provide a drawer mounting arrangement which will give an improved load carrying capacity without significantly reducing the available drawer width.

According to the invention there is provided a drawer mounting arrangement comprising at least two mounting unit combinations for slidably mounting the drawer to its surround, each said combination including a slider element adapted for attachment to said drawer and a rail element adapted for attachment to said surround, one element in said combination having at least two longitudinally extending parallel flanges projecting therefrom and laterally spaced one from the other, the other element in said combination having at least three longitudinally extending parallel flanges projecting therefrom and laterally spaced one from the other to define at least two substantially U-sectioned channels, said elements being mutually interengageable in load carrying relationship such that the flanges on said one element engage with the channels of said other element.

Preferably, both the rail and slider elements have four projecting flanges and the distal edge of the rail flanges terminate in a locally enlarged portion for reducing the bearing surface area between rail and slider.

Preferred embodiments of the invention will now be described, by way of example only, with reference to the accompanying drawings in which.

Figure 1:
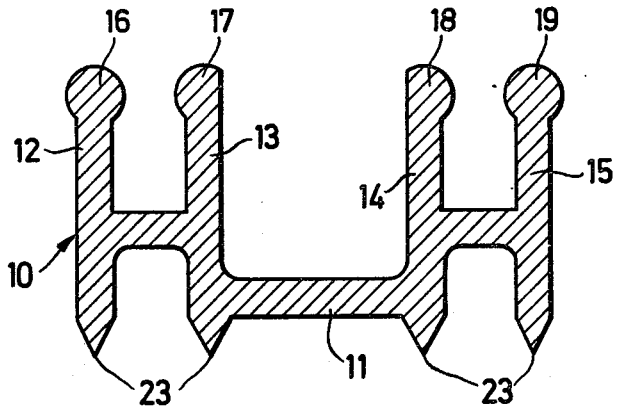
FIG. 1 is an enlarged transverse section through a rail element according to the invention.

Referring to the drawings, the rail element 10 illustrated in FIG. 1 is formed of extruded aluminium and includes a web portion 11 and four longitudinally extending parallel flanges 12, 13, 14 and 15 which are laterally spaced one from the other. In the embodiment being described, the rail element constitutes the said one element of the mounting unit combination illustrated in FIG. 6. The distal edge of each flange is provided with an enlarged, rounded portion 16, 17, 18 or 19, respectively.

Figure 6:
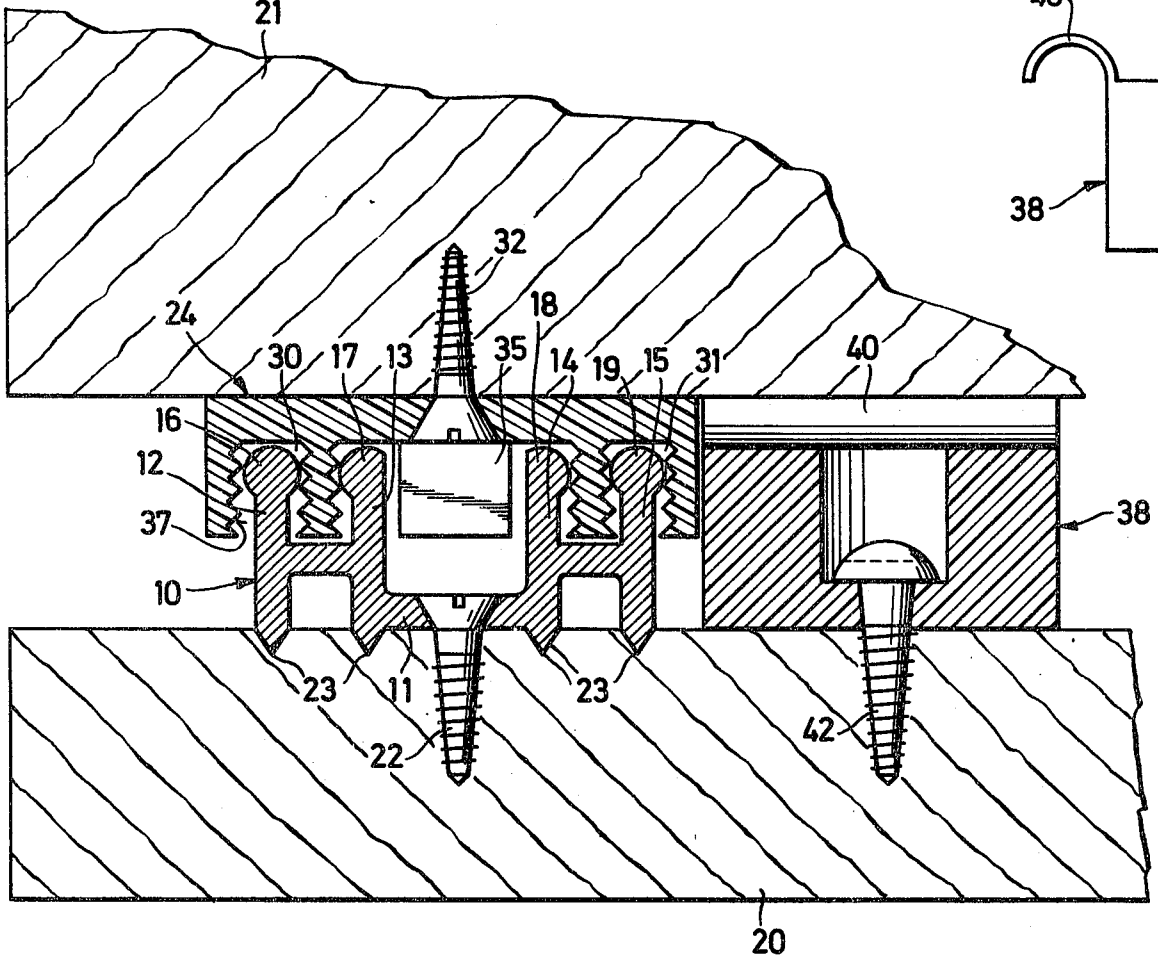
FIG. 6 is a sectional view on a different scale, showing a mounting unit combination according to the invention in position beside a drawer, the unit employing the rail element of FIG. 1 and the slider element of FIG. 2.

As shown in FIG. 6, the rail element 10 is adapted for attachment to the inner wall 20 of a drawer recess, on either side of the drawer 21 by screws 22 passing through spaced holes in the web 11. To aid in the rigid securement of the rail element to a wooden frame, four sharpened edges 23 are provided which bite into the wooden frame as shown in FIG. 6 to assist in holding the rail element securely.

Figure 2:
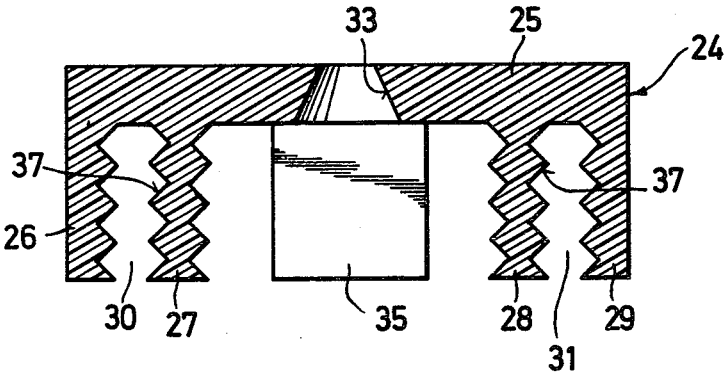
FIG. 2 is a transverse section through a slider element according to the present invention suitable for use in combination with the rail element shown in FIG. 1.
Figure 3:
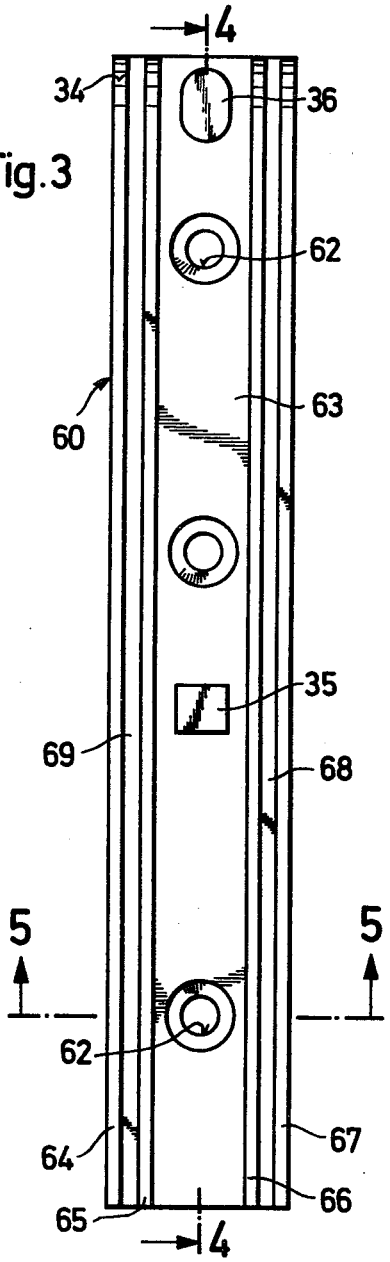
FIG. 3 is a side elevation on a different scale of a modified slider element suitable for use in combination with the rail element shown in FIGS. 8 and 9.
Figure 4:
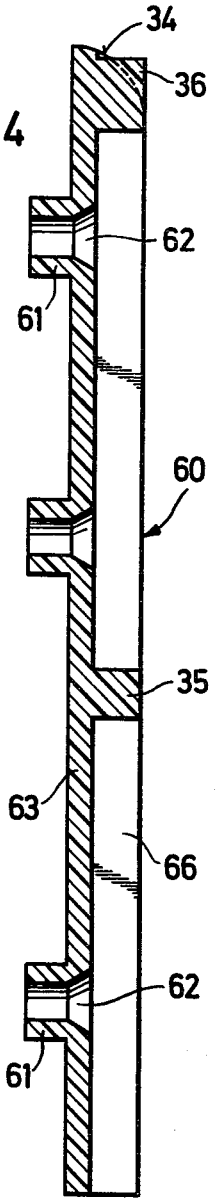
FIG. 4 is a sectional view taken on line 4—4 of FIG. 3.
Figure 5:
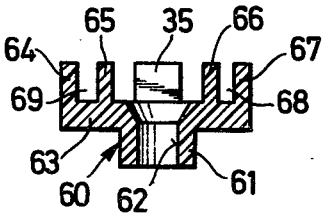
FIG. 5 is a sectional view taken on line 5—5 of FIG. 3.

A corresponding slider element suitable for use with the rail element of FIG. 1 in forming the mounting unit combination illustrated in FIG. 6 is shown in section in FIG. 2. FIGS. 3, 4 and 5 show a similar slider element suitable for use with the modified mounting unit combination illustrated in FIG. 9.

The slider element 24 illustrated in FIG. 2 is formed of a plastics material such as nylon and includes a web portion 25 and four longitudinally extending parallel flanges 26, 27, 28 and 29 which are laterally spaced one from the other to define two substantially U-sectioned channels 30 and 31. In this embodiment, the slider element 24 constitutes the said other element of the mounting unit combination illustrated in FIG. 6. As shown in FIG. 6, the slider element 24 is located on opposite longitudinal sides of the drawer 21 adjacent its rear end by screws 32 passing through suitably spaced holes 33 formed in the web 25.

In side elevation, the slider element 24 appears substantially as shown in FIG. 3 wherein it will be noticed that a curved leading edge 34 assists in locating the drawer on its two rail elements while a projecting abutment 35 extends from the web between the innermost flanges to act as a stop to prevent unintentional removal of the drawer as will be described below. The web also supports an additional projection 36 which serves to steady the drawer when in its fully open position.

When the slider element 24 and its corresponding element 10 are interengaged as shown in FIG. 6 it will be noticed that the rail element flanges 16 and 19 engage with ridges formed by the slider element channels 30 and 31 respectively. By this configuration, each mounting unit combination provides three regions of substantially line contact support, at the ends of the triangular ridges, for the drawer regardless of the direction of applied loading. In view of the manufacturing tolerances, only one region of line contact may be present when the drawer is lightly loaded, but as this loading is increased, the resilience of the slider element permits a deflection of the slider flanges until the loading is distributed over enough of the three possible bearing regions to support the load. Clearly, the fit between the rail and slider should be as close as possible, consonant with the need to provide freedom of movement without possible jamming.

Figure 7:
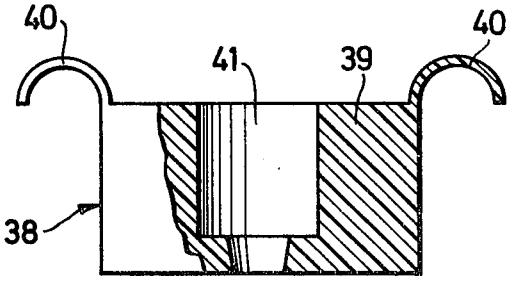
FIG. 7 is a plan view of a spacer element shown in FIG. 6.

The slider flanges may be smooth as shown in FIG. 5, but are preferably provided with a plurality of grooves 37 to assist in locating the enlarged distal edge portion of the rail flanges. Alignment of the drawer and its associated mounting units is also assisted by the provision of one or more spacer elements 38 adjacent the front of the drawer in its closed position. The spacer element 38 comprises a block 39 of resilient, low friction material such as nylon and, as shown in FIGS. 6 and 7 includes a pair of resilient, arcuate leaves 40 which bear against the side of the drawer 21 to assist in maintaining its correct spacing and alignment. Each spacer element is provided with a stepped bore 41 for accepting a mounting screw 42 which secures the spacer to the wall 20. The slider element 10 as shown in FIG. 6, is located on a side of the drawer 21, which lies in a vertical plane, and the spacer block 38 is vertically spaced from the rail and slider elements 10 and 21.

Figure 10:
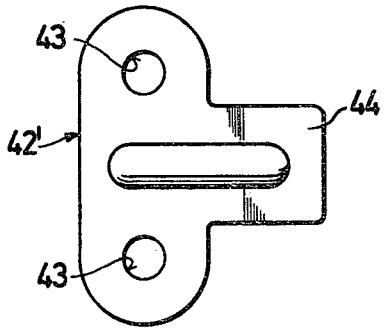
FIG. 10 is a plan view of a retaining stop suitable for use with the invention.
Figure 11:
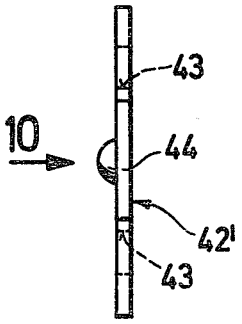
FIG. 11 is a side elevation of the stop shown in FIG. 10.

Removal of the drawer is prevented by a retaining stop 42' such as that illustrated in FIGS. 10 and 11. The retaining stop is attached by means of securement holes 43 to the side wall 20 at one or both ends of the rail 10 such that a tongue portion 44 projects into the path of projections 35 and 36. A stop positioned at the rear of the rail 10 will limit retraction of the drawer by interference with projection 36, while a stop located at the forward end of the rail will contact projection 35 so as to prevent accidental removal of the drawer.

It will be appreciated that the provision of a plurality of bearing flanges on the slider and rail provides increased load carrying capacity for the mounting unit without substantially increasing the lateral width of the unit with a corresponding reduction in available drawer width. Furthermore, the arrangement also provides substantial resistance against the twisting loads imposed by the drawer. The preferable distal enlargement on the rail flanges ensure that only substantially line contact is made between the rail and slider, thereby reducing the frictional force for any given loading.

Figure 8:
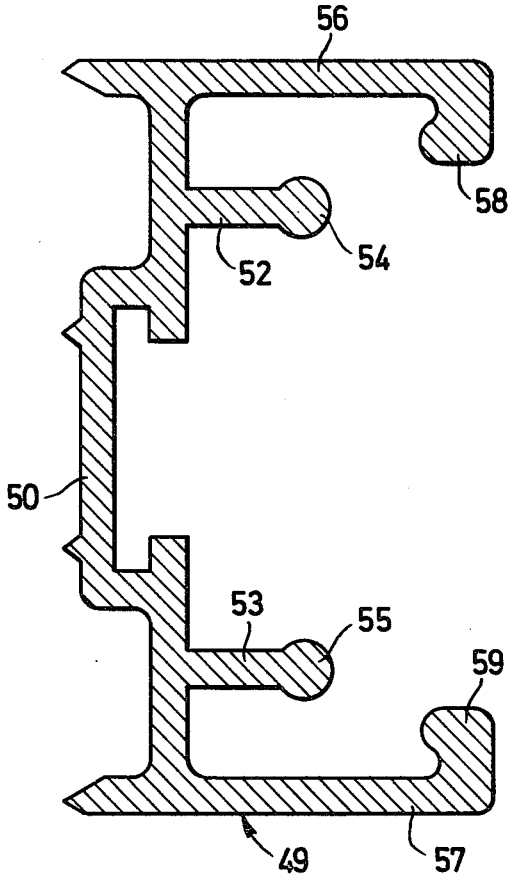
FIG. 8 is a transverse section through a modified rail element according to the invention.

The present invention also provides a drawer mounting arrangement in which the mounting units can be located beneath the drawer in situations where it may not be desirable to utilise the side mounting arrangement described above. Such a mounting arrangement is illustrated in FIG. 9 and employs a rail element as shown in FIG. 8 in combination with the slider element illustrated in FIGS. 3, 4 and 5, the rail element of FIG. 8 being illustrated on a larger scale.

The modified rail element 49 includes a web portion 50 provided with a plurality of attachment holes for securing the rail to the floor of the drawer surround 51. Extending from the web portion 50 are two longitudinally extending parallel flanges 52 and 53, each provided with an enlarged distal portion 54 or 55 respectively. Also extending from the web portion 50 are opposite side-flanges 56 and 57 which extend generally parallel with the inner flanges 52 and 53 but include inwardly extending retention pieces 58 and 59 respectively so that the side-flanges extend at least partially around the slider element 60 to prevent excessive upward movement of the slider element relative to the rail element, as shown in FIG. 9. The method of attachment of the rail element 49 to the drawer surround is essentially identical with that described for the side-mounted rail element 10.

Figure 9:
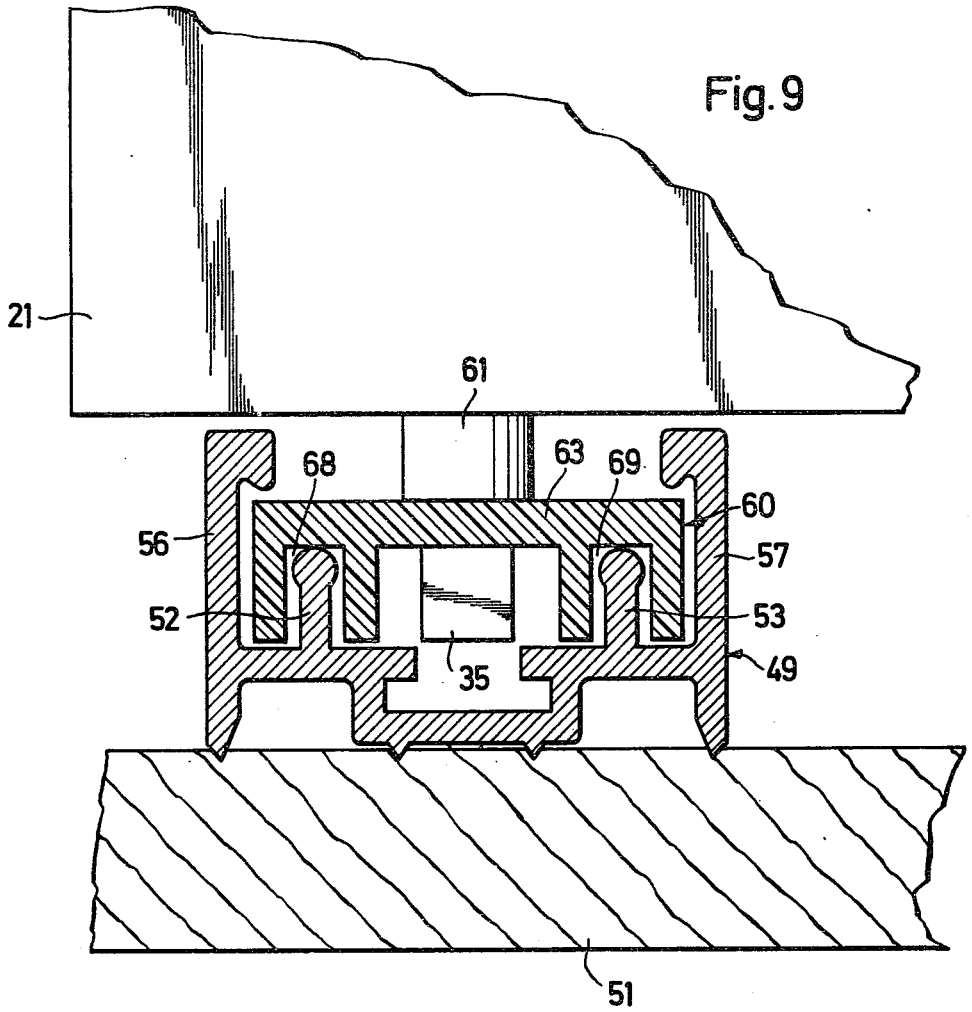
FIG. 9 is a view on a different scale showing a modified mounting unit combination in position beneath a drawer, the unit employing the rail element of FIG. 8 and the slider element of FIGS. 3, 4 and 5.

The slider element 60 for use in the embodiment illustrated in FIG. 9 is shown in FIGS. 3, 4 and 5 and is substantially identical with the slider illustrated in FIG. 6 except for the provision of spacing bosses 61 and the absence of grooves 37. The slider element 60 is secured to the underside of the drawer 21 by attachment screws passing through spaced apertures 62. The provision of the spacer bosses 61 ensures that the slider element projects beneath the drawer a sufficient distance to provide clearance for the rail element side-flanges 56 and 57. As in the case of the slider element 24 shown in FIG. 6, the slider 60 includes a web portion 63 supporting four longitudinally extending parallel flanges 64, 65, 66 and 67. These flanges define two substantially U-sectioned channels 68 and 69 with which the slider element flanges 52 and 53 interengage in load carrying relationship as shown in FIG. 9.

It will be appreciated that the embodiment of the invention illustrated in FIG. 9 permits the drawer to be mounted in a way which does not reduce the available drawer width and which provides two bearing regions of substantially line contact for each mounting unit. The arrangement also provides for accurate alignment of the drawer and affords substantial resistance against sideways twisting.

Although the invention has been described with reference to specific examples, it will be appreciated by those skilled in the art that the invention may be embodied in many other forms without departing from the scope of the inventive concept.

The claims defining the invention are as follows:

1. A drawer mounting arrangement comprising:

a drawer frame;

a drawer slidable in said frame;

a slider element mounted on said drawer;

a rail element mounted on said frame and slidably supporting said slider element; and a spacer element attached to said frame adjacent to said rail, and bearing against a side of the drawer to keep it spaced from said frame, said spacer element including a block of resilient material attached to said frame, said block having at least one resilient leaf extending therefrom for sliding engagement with said drawer.

2. In a drawer mounting arrangement which includes a drawer slidable in a drawer frame, the improvement of a mounting arrangement comprising:

a slider element mountable on said drawer; and a rail element mountable on said frame to slidably support said slider element;

one of said elements having a pair of longitudinally-extending parallel first flanges;

the other of said elements having a second flange that extends between said first flanges, said second flange having an enlarged rounded distal end for lying between said first flanges;

at least one of said first flanges having longitudinally-extending parallel grooves which form longitudinally-extending parallel ridges that slidably engage the enlarged rounded end of the second flange when the second flange lies between the first flanges, said ridges being of substantially triangular cross section to avoid bending of the ridge and to provide a narrow edge for making substantially line contact with the rounded end of the second flange.

* * * * *